US006039033A

United States Patent [19]

Kim et al.

[11] Patent Number: 6,039,033

[45] Date of Patent: Mar. 21, 2000

[54] APPARATUS OF EXHAUST GAS RECIRCULATION VALVE FOR AN INTERNAL COMBUSTION ENGINE

[75] Inventors: Kyung Woon Kim, Pucheon; Hong Cheol Lee, Incheon, both of Rep. of Korea

[73] Assignee: Daewoo Motor Co., Ltd., Incheon, Rep. of Korea

[21] Appl. No.: 09/125,413

[22] PCT Filed: Dec. 8, 1997

[86] PCT No.: PCT/KR97/00261

§ 371 Date: Aug. 17, 1998

§ 102(e) Date: Aug. 17, 1998

[87] PCT Pub. No.: WO98/28534

PCT Pub. Date: Jul. 2, 1998

[30] Foreign Application Priority Data

Dec. 24, 1996 [KR] Rep. of Korea ..... 96-71921

[51] Int. Cl.[7] ..... F02M 25/07

[52] U.S. Cl. ..... 123/568.17; 123/568.29; 123/184.42

[58] Field of Search ..... 123/568.11, 568.12, 123/568.17, 568.18, 568.27, 568.29, 184.38, 184.42

[56] References Cited

U.S. PATENT DOCUMENTS

| | | | |
|---|---|---|---|
| 4,643,136 | 2/1987 | Ura et al. | 123/184.42 |
| 4,909,036 | 3/1990 | Kimura | 123/568.17 |
| 4,938,176 | 7/1990 | Tanaka et al. | 123/568.17 |
| 5,427,080 | 6/1995 | Maeda et al. | 123/184.42 |
| 5,666,930 | 9/1997 | Elder | 123/568.17 |
| 5,669,364 | 9/1997 | Everingham | 123/568.18 |
| 5,690,082 | 11/1997 | Tanioka et al. | 123/568.12 |

*Primary Examiner*—Willis R. Wolfe
*Attorney, Agent, or Firm*—Staas & Halsey

[57] ABSTRACT

The invention relates to an apparatus of an exhaust gas recirculation valve for an internal combustion engine for preventing the thermal effect on an intake manifold due to high temperature of recirculated exhaust gas. The apparatus of EGR valve is comprised of an exhaust gas recirculation valve consisting of a body and an adapter having a second flange which causes the body to be attached on a first flange of the intake manifold. A gap of 3 mm to 5 mm separates a first border of the first flange from a second border of the adapter.

9 Claims, 4 Drawing Sheets

APPARATUS OF EXHAUST GAS RECIRCULATION VALVE FOR AN INTERNAL COMBUSTION ENGINE

TECHNICAL FIELD

The present invention relates to an apparatus of: Exhaust Gas Recirculation (EGR) Valve for an internal combustion engine. Particularly, the present invention relates to an apparatus of EGR valve for preventing the thermal effect on a plastic intake manifold due to high temperature of recirculating gas.

BACKGROUND ART

An Exhaust Gas Recirculation (EGR) control is a control system for reducing NOx of exhaust gas. A passage is provided for recirculating exhaust gas between an exhaust manifold and a downflow portion of a throttle valve of an intake manifold. An EGR valve or a flow control valve for regulating the proper volume of the recirculating gas is provided on the passage.

In general, an intake manifold is made from aluminum casting. Also, the EGR valve is made from aluminum casting. That results in heavy weight of the engine, thereby causing the rate of fuel consumption to be increased.

To solve the problem, a metal intake manifold was substituted with a plastic intake manifold in a conventional technique. However, as shown in FIG. 5, since EGR adapter 20P having EGR valve 210P contacts with a frame 10P of an intake manifold made from a plastic material, and the heat of the high temperature exhaust gas is directly transferred to the plastic frame 10P, the intake manifold seems to deform or deteriorate within its mechanical character.

Further, to solve the problem an exhaust gas passage is installed by being detoured near an outside of the cylinder head. However, various parts can not be installed near the high temperature exhaust gas pipe so voluminous space of the engine compartment is necessary.

It is an object of the present invention to provide an apparatus of EGR valve for an internal combustion engine to solve the above problems.

It is a further object of the present invention to provide an apparatus of EGR valve for an internal combustion engine in which the thermal effect on a plastic intake manifold due to high temperature of recirculating gas is prevented.

It is a further object of the present invention to provide an apparatus of EGR valve for an internal combustion engine in which the space in the engine compartment can be efficiently utilized.

In order to achieve the above objects of the present invention, an apparatus of Exhaust Gas Recirculation Valve comprises an intake manifold mounted on an outer wall of an engine cylinder head and having a first flange at one end of the intake manifold; and an exhaust gas recirculation valve for delivering exhaust gas discharged from a combustion chamber of the engine to the intake manifold; the exhaust gas recirculation valve attached on the first flange by an adapter having a second flange; wherein a gap is provided between a first border of the first flange and a second border of the adapter, thereby interrupting heat transfer, the first border facing to the adapter and the second border facing to the first border.

Further, the gap is evenly between the first border and the second border.

Furthermore, the gap has a depth by partial contact with the first flange and the second flange.

Further, the exhaust gas of combustion chamber is delivered to the Exhaust Gas Recirculation Valve through a passage formed in a cylinder head.

BRIEF DESCRIPTION OF THE DRAWINGS

Embodiments of the present invention will hereinafter be described, by way of example, with reference to the accompanying drawings in which.

BEST MODE FOR CARRYING OUT THE INVENTION

Figure 1:
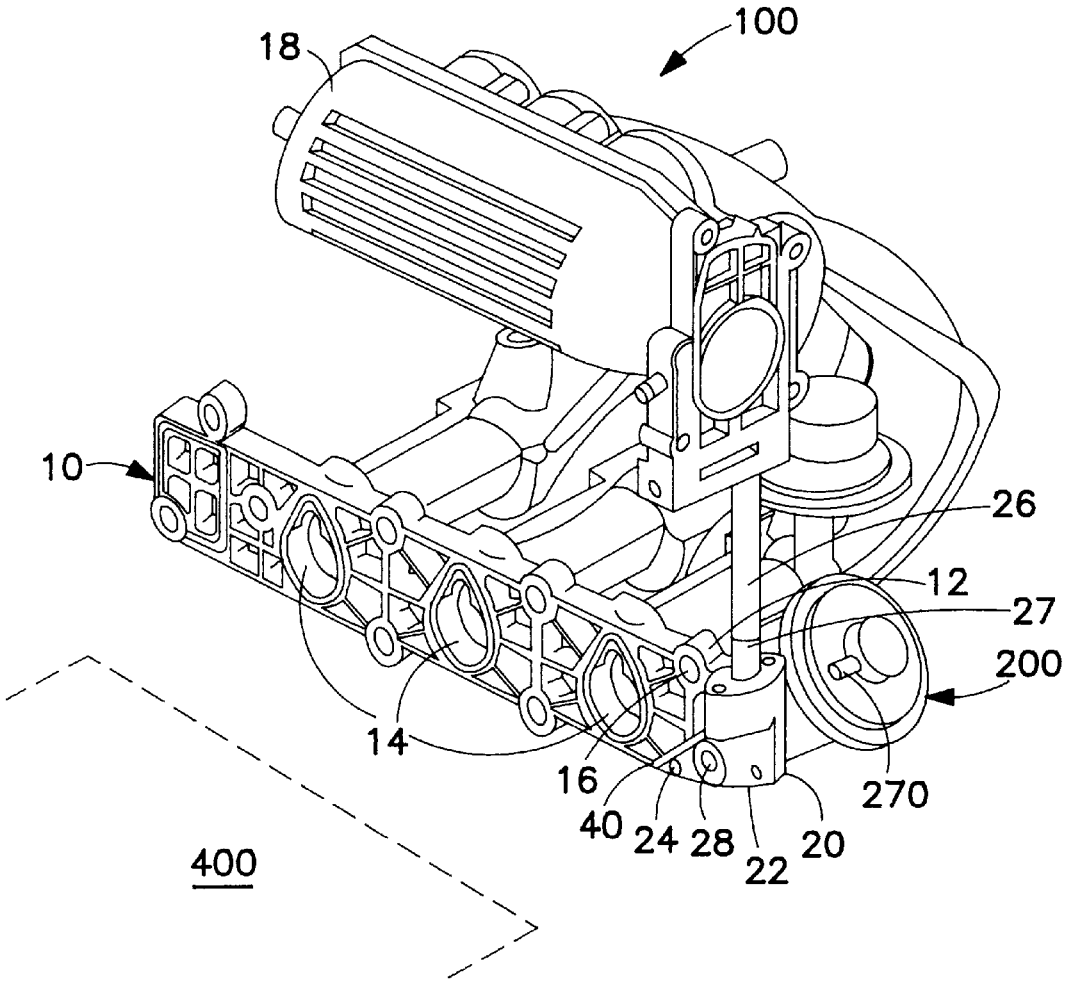
FIG. 1 is a perspective view illustrating that an Exhaust Gas Recirculation Valve is assembled with an intake manifold according to the present invention.

FIG. 1 illustrates the present inventive Exhaust Gas Recirculation (EGR) valve 200 and an intake manifold 100 assembled with the EGR valve 200. The intake manifold 100 is integrally molded with a plenum chamber 18 made from a thermoplastic material. Furthermore, the intake manifold 100 has a frame 10 integrally molded at an attaching portion of the cylinder head 400. A first flange 12 which is assembled with a second flange of EGR valve body that is illustrated later is integrally molded to the intake manifold frame 10.

The EGR valve 200 is comprised of a body 210 and an adapter 20 in which the body 210 is attached to the engine cylinder head 400 by a bolt (not shown) through a hole 24. Furthermore, the adapter 20 has a second flange 22 enabling the adapter to be placed on the intake manifold frame 10. Also, the adapter 20 is made from aluminum.

The adapter 20, moreover, has a nipple 27 which is connected with the plenum chamber 18 by an exhaust gas recirculation pipe 26. On the other hand, a nipple 270 is formed at the EGR body 210 and is connected with a throttle body (not shown) attached to the plenum chamber 18 by an vacuum pipe (not shown).

Figure 2:
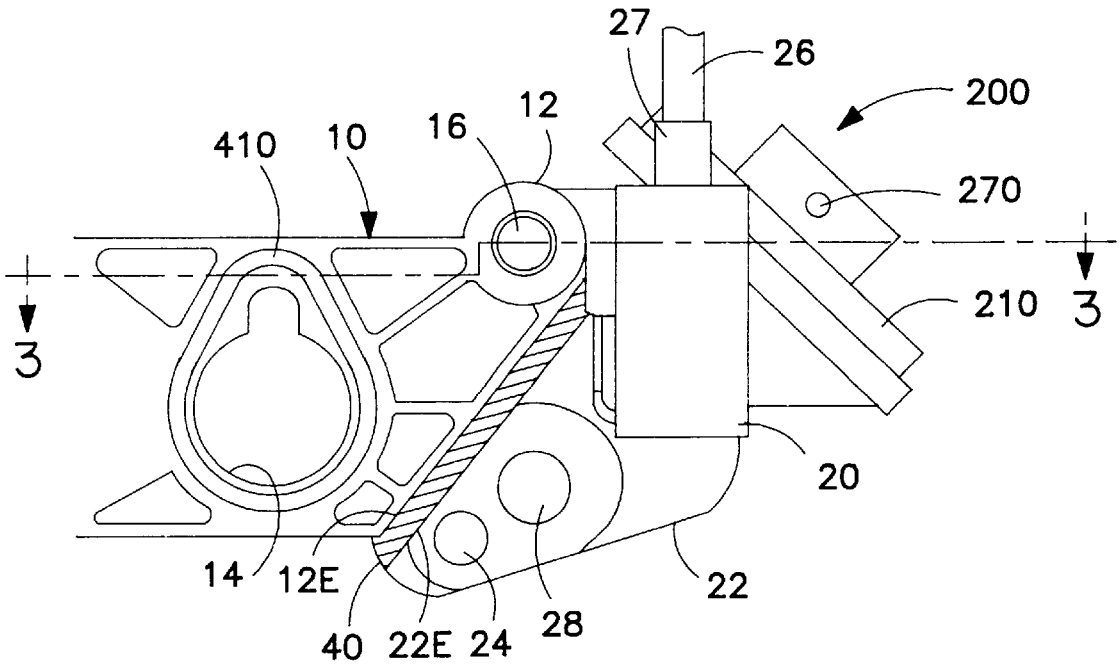
FIG. 2 is a front view of an EGR valve assembled with an intake manifold of FIG. 1.
Figure 3:
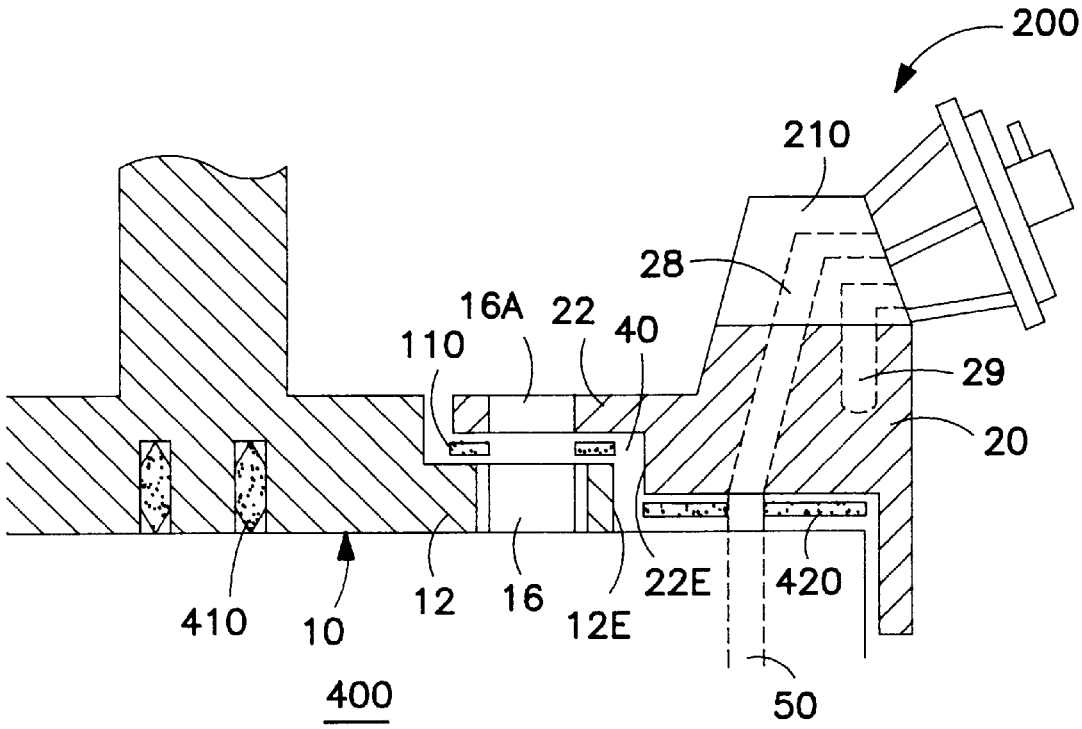
FIG. 3 is a horizontal cross-sectional view of an EGR valve attached on a cylinder head along line 3—3 of FIG. 2.
Figure 4:
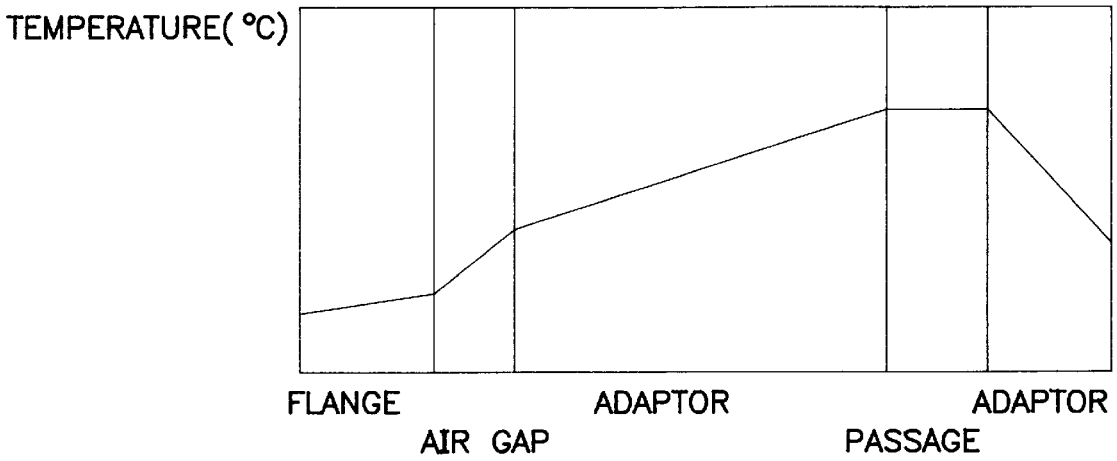
FIG. 4 is a graph illustrating heat transfer between an intake manifold and an EGR valve according to the present invention.
Figure 5:
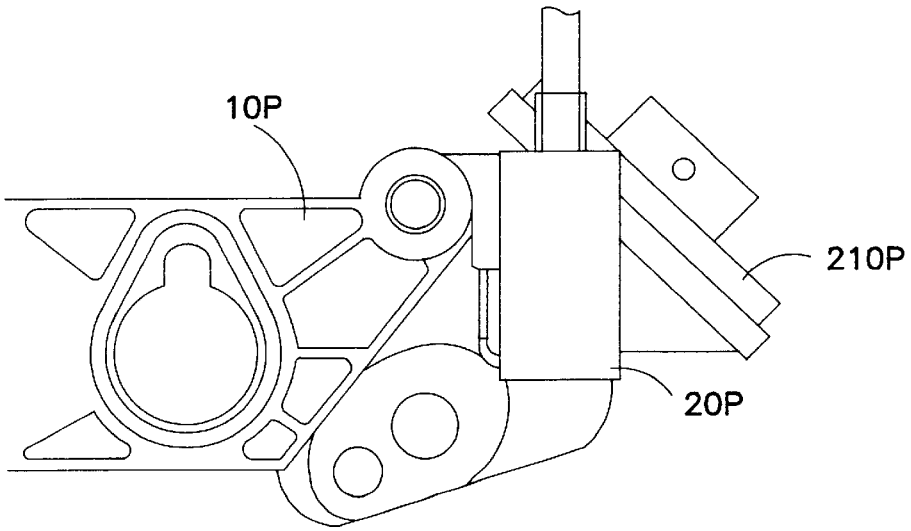
FIG. 5 is a front view of an EGR valve assembled with an intake manifold according to the prior art.

FIGS. 2 and 3 show the EGR valve assembled with the intake manifold frame 10.

The frame 10 of the intake manifold 100 is mounted on an exterior wall of the cylinder head 400. At this time, to prevent leakage of mixed fresh air intaken into the cylinder head 400, a gasket 410 is provided around a passage 14 of the frame 10. On the outward exposed surface of the frame 10 the second flange 22 of the adapter 20 is attached with the interposed gasket 110. At this time, another gasket 420 is interposed between the cylinder head 400 and an inward exposed surface of the adapter 20. Thereafter, the intake manifold 100 and the adapter 20 are mounted on the cylinder head 400 by a bolt (not shown) which is inserted in a hole 16A of the second flange 22 and a hole 16 of the first flange 12. An exhaust gas passage 50 formed in the cylinder head 400 is coaxially arranged with a passage 28 formed in the adapter 20 for receiving exhaust gas through the exhaust gas passage 50. Further, the adapter 20 is closely assembled with the cylinder head 400 by a bolt (not shown) inserted in the hole 24 of the adapter 20.

A first border 12E of the flange 12 is spaced from a second border 22E of the EGR valve adapter 20. The space or gap 40 is formed in an equal distance between the first border 12E and the second border 22E. In the embodiment, the size of the cap 40 is 3 mm to 5 mm. That is, the gap 40 is configurated as a channel in which a shelf of the channel is covered with a second flange 22 of the adapter 20. Air is freely communicated through the inside of the channel or the gap 40.

The Exhaust Gas Recirculation Valve mounted by the same construction as above is operated as follows. High temperature exhaust gas discharged from a combustion chamber (not shown) of the engine flows into the passage 28 of the EGR adapter 20 through the passage 50 formed in the cylinder head 400. Heat of the high temperature exhaust gas in the passage 28 is transferred to the aluminum adapter 20, and the adapter 20 changes with the high temperature. However, it is difficult for heat of the adapter 20 to be transferred to the intake manifold 100 because of the gap 40 formed between the thermoplastic flange 10 and the adapter 20.

On the other hand, a passage (not shown) formed in the EGR valve body 210 is opened by a vacuum in the plenum chamber 18. Thus, exhaust gas of the passage 28 passes through the EGR valve body 210 and flows into the passage 29 of the adapter 20. The gas of the passage 29 flows into the plenum chamber 18 through the pipe 26 in order to be mixed with fresh air flowing into the plenum chamber 18 through a throttle valve (not shown). Thereafore, the mixed gas flows into a combustion chamber (not shown) through the intake manifold 100. Thus, due to heat capacity of $CO_2$ included in the mixed gas, the maximum temperature of combustion gas is decreased, thereby reducing volume of NOx.

According to the present invention as described above, since an adapter of EGR valve, through which high temperature exhaust gas has flowed, has a predetermined gap with respect to an intake manifold made from plastic, the plastic intake manifold is not affected by the heat of exhaust gas, and thus deformation of the intake manifold is prevented, thereby increasing reliability of the engine.

Further, since a passage through which the exhaust gas discharged from a combustion chamber enters into EGR valve is formed in a cylinder head, the space in the engine compartment is efficiently utilized and also mounting of the engine is convenient, thereby increasing productivity.

Furthermore, since an intake manifold and a plenum chamber are made from light weighted plastic, weight of the engine is lighter, thus reducing the fuel consumption ratio.

We claim:

1. An apparatus of an exhaust gas recirculation valve comprising:

an intake manifold, made from a thermoplastic material, mounted on an outer wall of a cylinder head and having a first flange at one end of said intake manifold; and an exhaust gas recirculation valve for delivering exhaust gas discharged from a combustion chamber of the engine through a passage formed in said cylinder head to said intake manifold;

said exhaust gas recirculation valve attached on said first flange by a metallic adapter having a second flange;

wherein an even distance gap is provided between a first border of said first flange and a second border of said adapter, thereby interrupting heat transfer, said first border facing to said adapter and said second border facing to said first border, and said gap being 3 mm to 5 mm.

2. An apparatus of an exhaust gas recirculation valve comprising:

an intake manifold mounted on an outer wall of a cylinder head and having a first flange at one end of said intake manifold; and an exhaust gas recirculation valve for delivering exhaust gas discharged from a combustion chamber of an engine to said intake manifold;

said exhaust gas recirculation recirculation valve attached on said first flange by an adapter having a second flange;

wherein a gap is provided between a first border of said first flange and a second border of said adapter, thereby interrupting heat transfer, said first border facing to said adapter and said second border facing to said first border.

3. The EGR valve apparatus according to claim 2, wherein said gap has a depth by partial contact with said first flange and said second flange.

4. The EGR valve apparatus according to claim 2, wherein said adapter is made from metal.

5. The EGR valve apparatus according to claim 2, wherein exhaust gas of combustion chamber is delivered to said exhaust gas recirculation valve through a passage formed in said cylinder head.

6. The EGR valve apparatus according to claim 2, wherein said gap is spaced evenly between said first border and said second border 22E.

7. The EGR valve apparatus according to claim 6, wherein said gap is 3 mm to 5 mm.

8. The EGR valve apparatus according to claim 2, wherein said intake manifold is made from a thermoplastic material.

9. The EGR valve apparatus according to claim 8, wherein said first flange is made from said thermoplastic material.

* * * * *

UNITED STATES PATENT AND TRADEMARK OFFICE

CERTIFICATE OF CORRECTION

PATENT NO.: 6,039,033
DATED : March 21, 2000
INVENTOR(S): Kyung KIM, et al.

It is certified that [an/error[s]] appears in the above-identified patent and that said Letters Patent is hereby corrected as shown below:

Column 4, Line 25, delete "recirculation" second occurrence

Signed and Sealed this

Twentieth Day of March, 2001

*Attest:*

Nicholas P. Godici

NICHOLAS P. GODICI

*Attesting Officer*

*Acting Director of the United States Patent and Trademark Office*